US008920575B2

(12) United States Patent
Hopponen et al.

(10) Patent No.: US 8,920,575 B2
(45) Date of Patent: Dec. 30, 2014

(54) METHOD FOR REMOVING FOREIGN MATTER FROM A DIGITAL HYDRAULIC PRESSURE CONTROLLER

(75) Inventors: Ville Hopponen, Mäntsälä (FI); Arto Ikonen, Järvenpää (FI)

(73) Assignee: Valmet Technologies, Inc., Espoo (FI)

( * ) Notice: Subject to any disclaimer, the term of this patent is extended or adjusted under 35 U.S.C. 154(b) by 625 days.

(21) Appl. No.: 13/322,827

(22) PCT Filed: Apr. 13, 2010

(86) PCT No.: PCT/EP2010/054793

§ 371 (c)(1),
(2), (4) Date: Nov. 28, 2011

(87) PCT Pub. No.: WO2010/136253

PCT Pub. Date: Dec. 2, 2010

(65) Prior Publication Data

US 2012/0067378 A1 Mar. 22, 2012

(30) Foreign Application Priority Data

May 29, 2009 (DE) ..... 10 2009 026 608

(51) Int. Cl.
*B08B 9/00* (2006.01)
*F15B 21/04* (2006.01)
*F15B 11/042* (2006.01)

(52) U.S. Cl.
CPC ..... *F15B 21/041* (2013.01); *F15B 11/0426* (2013.01); *F15B 2211/30565* (2013.01); *F15B 2211/40592* (2013.01)
USPC ..... 134/22.12; 134/22.1; 134/22.11; 134/22.18; 134/34

(58) Field of Classification Search
None
See application file for complete search history.

(56) References Cited

U.S. PATENT DOCUMENTS

2009/0114284 A1 5/2009 Siivonen et al.

FOREIGN PATENT DOCUMENTS

WO 2010136253 A1 12/2010

OTHER PUBLICATIONS

International Search Report for PCT/EP2009/054793 mailed Feb. 12, 2010.
Written Opinion of the International Searching Authority for PCT/EP2009/054793, mailed Nov. 29, 2011.

*Primary Examiner* — Eric Golightly
(74) *Attorney, Agent, or Firm* — Stiennon & Stiennon

(57) ABSTRACT

Foreign matter is removed from a digital hydraulic pressure controller having two portions connectable to each other and each including two valve arrays with a plurality of individually switchable valve means having different flow cross-sections and connected in parallel within a valve array. One valve array of each pressure controller portion can connect a supply line to a controller output line and the other valve array can connect the output line to a drain line. The two pressure controller portions are connected, the valve means having the largest flow cross-section of the valve array of the one portion on the supply line side is opened, the valve means having the largest flow cross-section of the valve array of the other portion on the drain line side is opened and the opened flow path is flushed through the pressure controller with pressurized working fluid, while the other valve means are closed.

14 Claims, 4 Drawing Sheets

METHOD FOR REMOVING FOREIGN MATTER FROM A DIGITAL HYDRAULIC PRESSURE CONTROLLER

CROSS REFERENCES TO RELATED APPLICATIONS

This application is a U.S. national stage application of International App. No. PCT/EP2010/054793, filed Apr. 13, 2010, the disclosure of which is incorporated by reference herein and claims priority on German App. No. 10 009 026 608.9 filed May 29, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a method of removing foreign matter from a digital hydraulic pressure controller of a hydraulic system and, more exactly speaking, to a method of removing foreign matter from a digital hydraulic pressure controller of a hydraulic system of a machine for producing a fibrous material web, especially a paper or board machine.

In paper machines, hydraulics is widely used as means of operation and control; in particular, actuators by means of which great forces can be adjusted and exerted with high precision are hydraulically driven.

Normally a working fluid, e.g. hydraulic oil, which is pressurized by a pump, is used. The introduction of the pressurized hydraulic oil into a hydraulic actuator, such as a hydraulic cylinder or a hydraulic motor, is typically controlled by a proportional control valve or a proportional valve which can be driven electrically, hydraulically or pneumatically.

Such a control valve has a movable or displaceable spool valve or control piston which, in response to its position within an associated valve housing, can adjust a target pressure at the output by regulating down the pressure of the hydraulic oil supplied by the pump. The mobility of the control piston in the valve housing requires a certain play or clearance between the control piston and the valve housing so that inner leakage of the control valve is unavoidable. The clearance must not be selected to be too narrow, since otherwise the valve would be too prone to contamination in the hydraulic oil.

Recently, alternative pressure controllers have been developed which shall consistently be referred to as digital hydraulic pressure controllers in the present application.

The mode of operation of the digital hydraulic pressure controllers is widely known already. For the sake of improved readability of the present application, however, the mode of operation of digital hydraulic pressure controllers is briefly summarized hereinafter:

In the simple case, a digital hydraulic pressure controller consists of a row of valves which are switched in parallel and which merely have an ON/OFF function; i.e. they are simple ON/OFF switching valves which permit or interrupt a flow and can consistently be referred to as valves in the present application. All of the valves are, on the one hand, connected to a common supply line and, on the other hand, to a common output line. The valves themselves can be conventional solenoid valves, i.e. valves having an electromagnetic drive. Of course, other drive forms may also be selected.

By connecting or installing throttle elements or by the valves themselves it is ensured that the valves have different flow cross-sections and thus different flows when they are opened; a throttle element together with a valve constitutes a valve means. If, for example, four valves are provided, the flow rates Q in the individual flow cross-sections each of which is selectively openable by the associated valve can be at a ratio of 1:2:4:8 with respect to each other; in the case of a larger number of valves, this row is continued accordingly.

By opening and closing individual valves or valve combinations which are determined and selected by a computer on the basis of mathematical models, a very rapid and precise pressure adjustment in the output line or in the actuator connected thereto can be achieved. This is accomplished by replacing the analog control curve of the proportional control valve described above by a digitally generated (approximated) control curve. Due to the omission of non-linearities and/or hysteresis of the analog proportional valve, this curve may be a straight line which is approximated stepwise and allows a set point to be approached quickly and (almost) free from overshoot.

It is another advantage of the digital hydraulic control that the valves are either open or closed, i.e. the valves are simply closed for maintaining a target pressure within a closed (and unchanged) system and there are no internal leakage flows. Thus a clear difference from the conventional proportional valve is given through which constantly a hydraulic oil flow is passed. This requires continuously energy for the hydraulic pumps, e.g. in the paper machine.

Consequently, it is evident that the use of digital hydraulic pressure controllers allows operating the hydraulic pumps less frequently and for a shorter time, whereby energy can be saved.

When operating a digital hydraulic control as described in the foregoing, it may happen that foreign matter occurs in the valves and/or in the common lines which may disturb a smooth operation of the control. Such foreign matter can get into the system, inter alia, when exchanging one or more of the valves during maintenance. Also air or air bubbles are referred to as foreign matter which may occur in the system when such digital hydraulic system is taken into operation for the first time. Foreign matter of this type must be removed or flushed out of the system for a faultless operation of the same.

SUMMARY OF THE INVENTION

In accordance with the invention, a method of removing foreign matter from a digital hydraulic pressure controller of a hydraulic system, in particular for a machine for producing a fibrous material web, is suggested. The pressure controller includes two pressure controller portions which are connectable to each other, for example, by an overflow valve and each of which includes two valve arrays. In each of the valve arrays a plurality of individually switchable valve means is provided, each having a different flow cross-section. Preferably the valve means of each valve array have flow cross-sections that are stepwise different from each other, i.e. a flow cross-section of a valve means of one valve array is larger or smaller by a predetermined value compared to a flow cross-section of another valve means of the same valve array. The valve means are connected in parallel within one valve array so that they form a parallel arrangement within one valve array. A valve array of each pressure controller portion can connect a supply line for supplying the digital hydraulic pressure controller with pressurized working fluid, such as hydraulic oil and the like, to a controller output line. The other valve array of the same pressure controller portion can connect the controller output line to a drain line for draining the working fluid from the pressure controller.

The method according to the invention comprises a step of connecting the two pressure controller portions, a step of opening the valve means having the largest flow cross-section of the valve array of the one pressure controller portion on the supply line side, a step of opening the valve means having the largest flow cross-section of the valve array of the other pressure controller portion on the drain line side and a step of flushing the opened flow path through the pressure controller with the working fluid, while the other valve means are closed.

In the afore-described method the longest possible flow path through the pressure controller having the largest possible flow cross-section is thus opened and flushed so that, inter alia, large foreign matter particles can be flushed out of the pressure controller.

In order to be capable of freeing further parts of the pressure controller from foreign matter the method according to the invention additionally comprises a step of opening the valve means having the next smaller flow cross-section of the valve array of the one pressure controller portion on the supply line side, a step of opening the valve means having the next smaller flow cross-section of the valve array of the other pressure controller portion on the drain line side and a step of flushing the opened flow path through the pressure controller with the working fluid, while the other valve means are closed.

The afore-mentioned steps are preferably repeated until all valve means of the valve array of the one pressure controller portion on the supply line side and all valve means of the valve array of the other pressure controller portion on the drain line side are flushed once with the working fluid and in this way are freed from foreign matter.

In order to free further parts of the pressure controller from foreign matter the previously described method moreover may comprise a step of opening the valve means having the largest flow cross-section of the valve array of the other pressure controller portion on the supply line side, a step of opening the valve means having the largest flow cross-section of the valve array of the one pressure controller portion on the drain line side and a step of flushing the opened flow path through the pressure controller with the working fluid, while the other valve means are closed.

In order to flush also the valves of the pressure controller not flushed before, the method moreover can comprise a step of opening the valve means having the next smaller flow cross-section of the valve array of the other pressure controller portion on the supply line side, a step of opening the valve means having the next smaller flow cross-section of the valve array of the one pressure controller portion on the drain line side and a step of flushing the opened flow path through the pressure controller with the working fluid, while the other valve means are closed.

The afore-described steps are preferably repeated, until all valve means of the valve array of the other pressure controller portion on the supply line side and all valve means of the valve array of the one pressure controller portion on the drain line side are flushed. It is possible by the method according to the invention comprising all afore-described steps to flush all valve means and all lines connecting them with the working fluid so as to remove all foreign matter from the digital hydraulic pressure controller.

The pressurized working fluid according to the method according to the invention is preferably stored in a pressure reservoir before flushing. It is furthermore preferred that the working fluid is pressurized by a pump.

In addition, the method according to the invention preferably comprises a step of collecting the working fluid, after the step of flushing, in a tank for storing non-pressurized working fluid.

Hereinafter the invention is illustrated in detail as regards different aspects by way of exemplary configurations with reference to the drawings.

DESCRIPTION OF THE PREFERRED EMBODIMENTS

Figure 1:
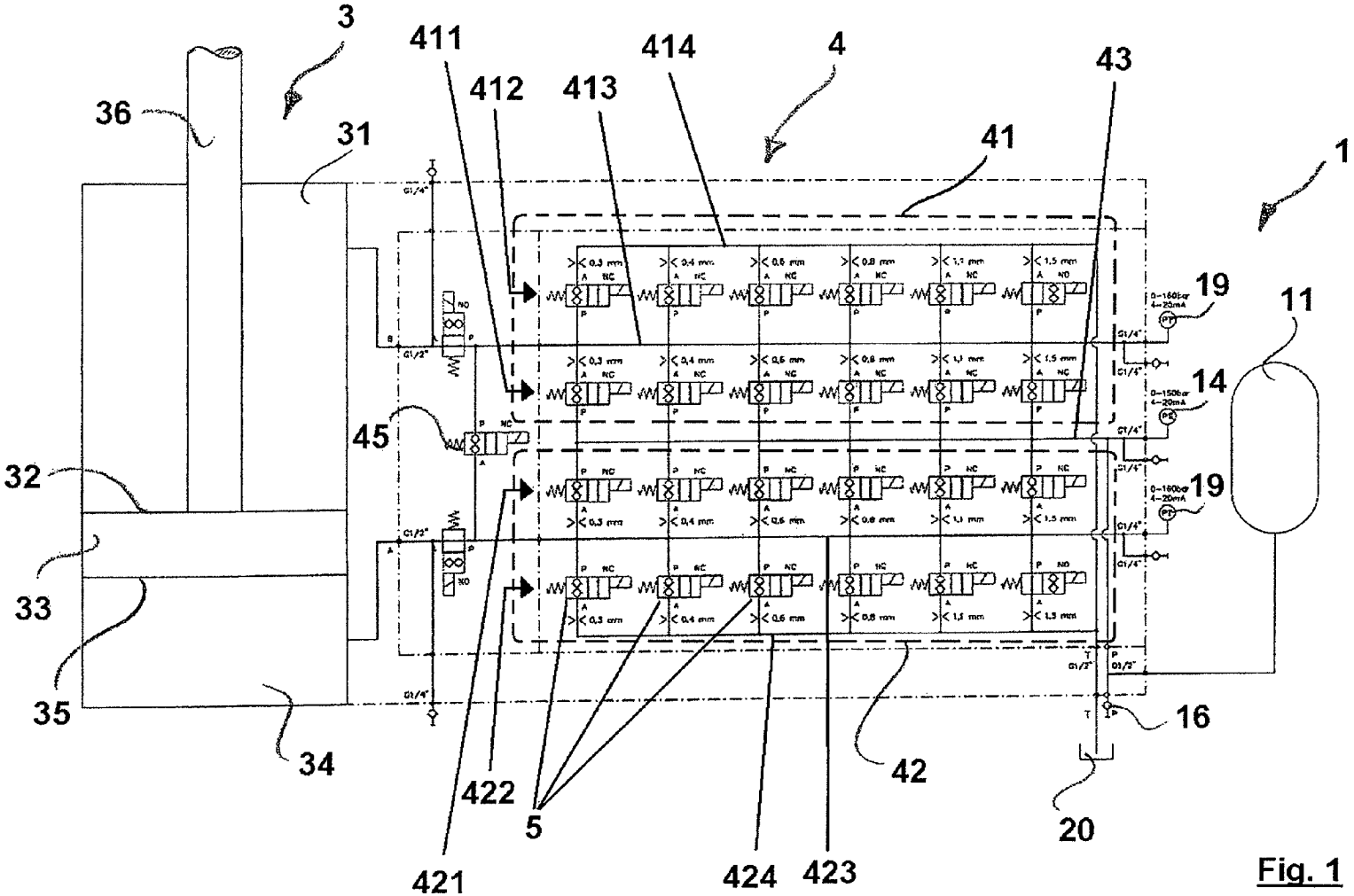
FIG. 1 shows a portion of a hydraulic system comprising a pressure reservoir, a digital hydraulic pressure controller and a hydraulic differential cylinder in a schematic diagram.

In the following description of figures equal elements or elements having equal functions are denoted with the same reference numerals so that the general description of function is made merely by way of one figure which is then referred to. If furthermore the following text mentions a pressure controller, this is, unless otherwise stated, a digital hydraulic pressure controller the operation of which makes use of the digital hydraulic principle illustrated at the beginning of the description.

FIG. 1 shows a portion of a hydraulic system comprising a pressure reservoir 11, a digital hydraulic pressure controller 4 and a hydraulic differential cylinder 3 in a schematic diagram. A supply portion 1 comprising a pump pressure reservoir 11, a pump 16 and a tank 20 supplies the pressure controller 4 with pressurized working fluid. The pressure controller 4 has two pressure controller portions 41, 42 to operate a differential cylinder 3. Sensors 19 detect, by way of output lines 413, 423, the pressure prevailing in the two pressure chambers 31 and 34 of the differential cylinder 3 which are separated by a piston 33 including a piston rod 36. The pressure prevailing in the rod-side pressure chamber 31 acts on the rod-side piston surface 32, while the pressure in the piston-side pressure chamber 34 acts on the piston surface 35. By the pressure controller portions 41 and 42 the filling quantity and the pressure can be adjusted in the two pressure chambers 31 and 34 so that the piston rod 36 interacts with a connected machine element (not shown) at the desired position and with the desired force. Each pressure controller portion 41, 42 is connected to a respective output line 413, 423 and to a respective drain line 414, 424. Moreover, each pressure controller portion 41, 42 has a valve array 411, 421 on the supply line side and a valve array 412, 422 on the drain line side. Depending on whether valves of the arrays are open or closed, the valve array 411, 421 on the supply side can connect the supply line 43 to the respective output line 413, 423. Analogously to that, the valve array 412, 422 on the drain line side can connect the respective output line 413, 423 to the respective drain line 414, 424.

The pressure prevailing in the pressure supply 1, on the basis of which the cylinder 3 has to be controlled, is measured by means of the pressure sensor 14 and, based thereon, the target pressure is adjusted in the pressure chambers 31 and 34. Reference numeral 45 denotes an overflow valve selectively allowing a connection of the two pressure chambers 31 and 34. The function of said overflow valve 45 which can be switched to pass, separates the controller portions 41, 42 and the pressure chambers 31, 34 from each other in the closed state. When the overflow valve 45 opens, the two pressure chambers are interconnected or short-circuited. Usually a load or force is applied to the piston rod which is intended to force the piston rod into the cylinder. If the piston rod is to be pulled into the cylinder following the load, as this occurs upon opening a roller gap, for instance, the overflow valve 45 is opened and the control valves of the controller portion on the piston rod side remain closed. Hence, the working fluid partly flows into the piston-side pressure chamber 31 and partly into the tank (not shown). The drain into the tank is controlled by the cylinder-side controller portion 42 and thus the lowering velocity of the piston rod is regulated.

Figure 2:
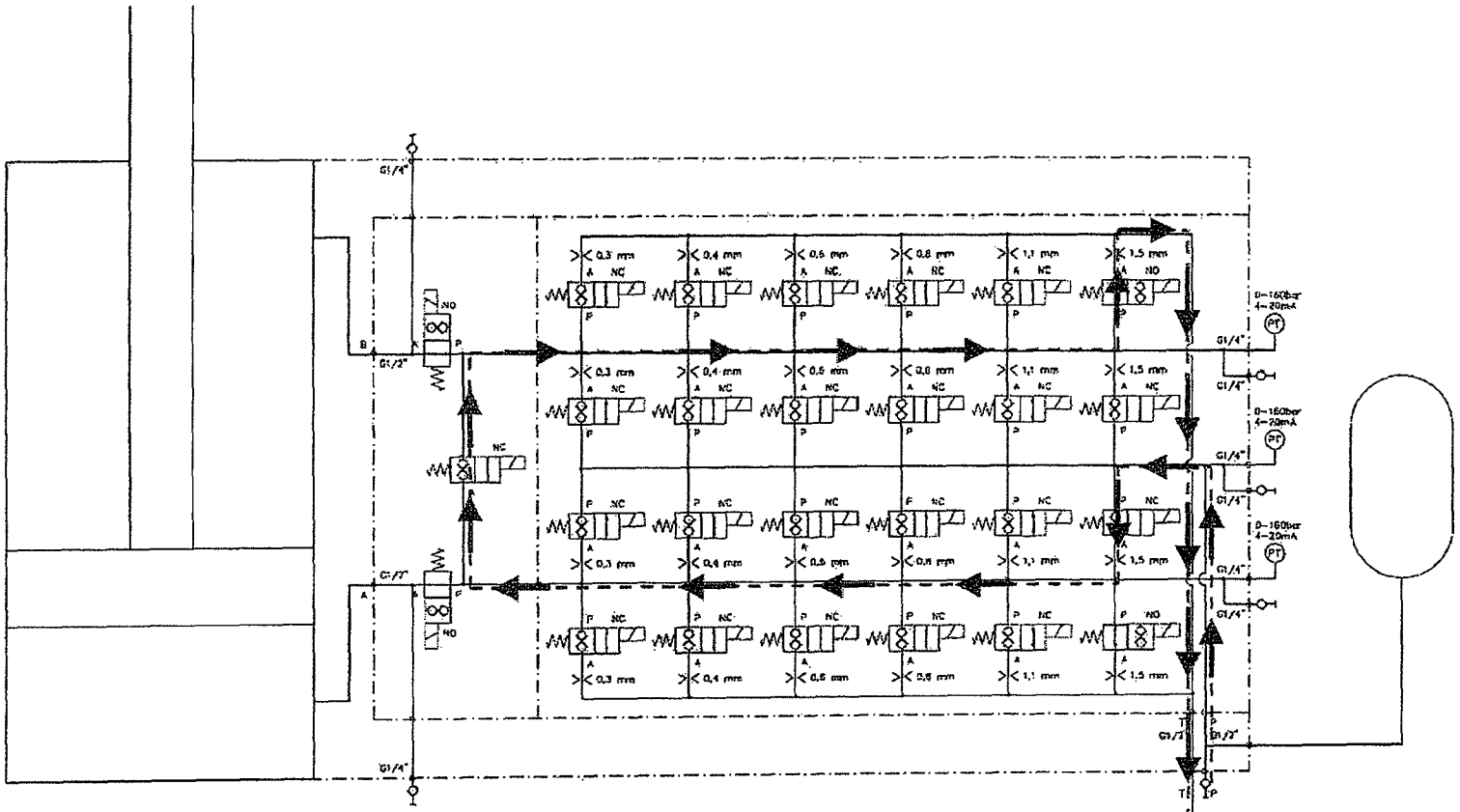
FIG. 2 shows the schematic diagram illustrated in FIG. 1 in which an opened flow path for flushing the pressure controller shown in FIG. 1 is shown with a particular switching of valves of the pressure controller.

FIG. 2 illustrates a flow path opened by the method according to the invention in which the pressurized working fluid is delivered by the pump 16 via the supply line 43 through the valve having the largest flow cross-section, in this example a flow cross-section diameter of 1.5 mm, of the valve array 421 of the pressure controller portion 42 on the supply line side into the output line 423. Since the output line 423 of the pressure controller portion 42 is communicated via the open overflow valve 45 with the output line 413 of the pressure controller portion 41, the working fluid is delivered into the output line 413 and further through the valve having the largest flow cross-section, in this example having a flow cross-section of 1.5 mm, of the valve array 412 of the pressure controller portion 41 on the drain line side into the tank 20 and is collected there. In this procedure flushing of the longest flow path having the largest flow cross-section of the pressure controller 4 is obtained, wherein foreign matter present in the flushed parts of the pressure controller 4 is flushed out and thus removed from the pressure controller 4.

Figure 3:
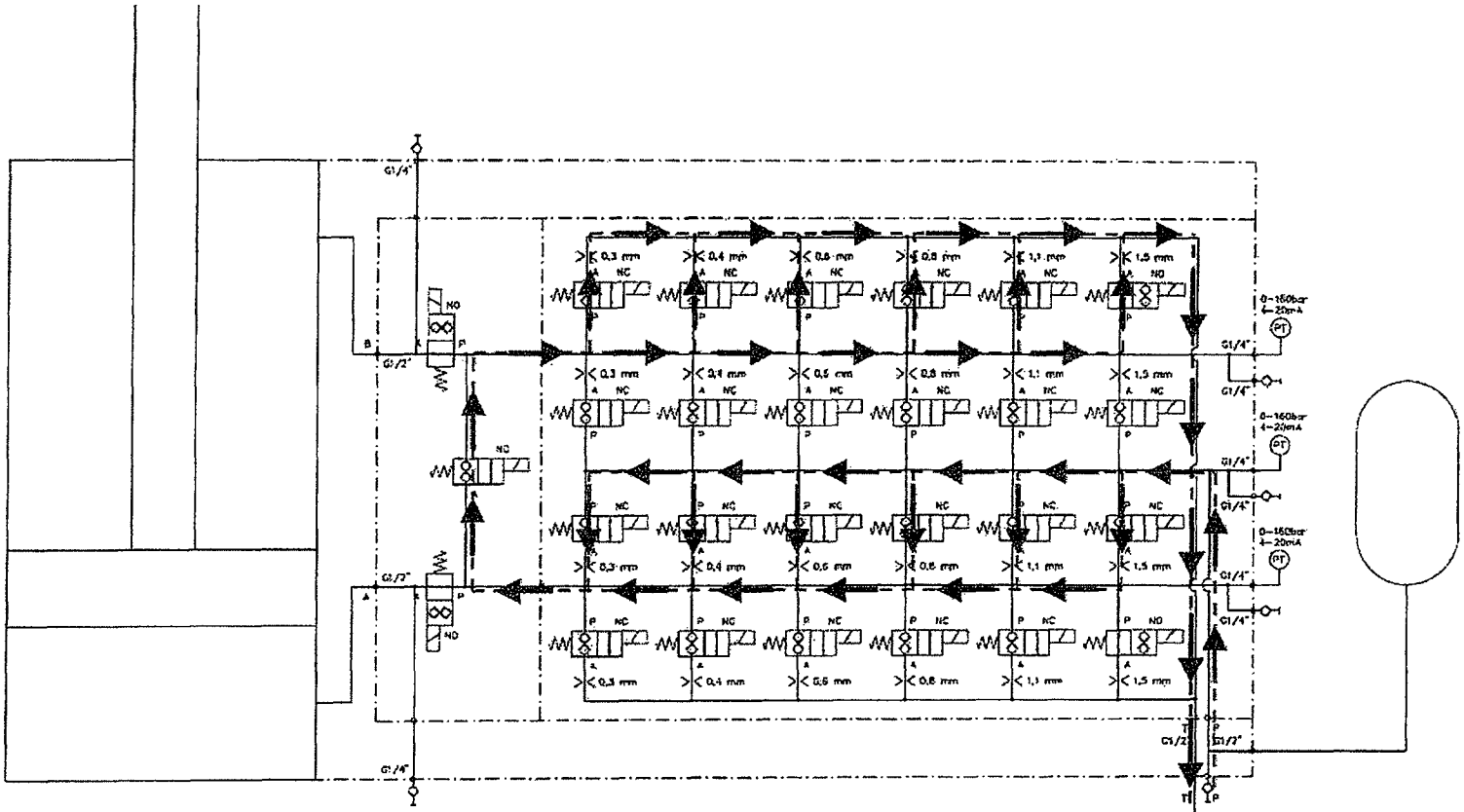
FIG. 3 shows the schematic diagram illustrated in FIG. 1 in which a flow path for venting a part of the pressure controller shown in FIG. 1 is shown with a particular switching of valves of the pressure controller.

A switching of the pressure controller 4 for venting a first part of the pressure controller 4 is shown in FIG. 3. As illustrated in FIG. 2 and described before, first the longest flow path having the largest possible flow cross-section of the pressure controller 4 is flushed. Afterwards, in the method shown in FIG. 3 the valve having the next smaller flow cross-section in the valve array 421 of the pressure controller portion 42 on the supply line side and the valve having the next smaller flow cross-section of the valve array 412 of the pressure controller portion 41 on the drain line side are opened. Then the working fluid is flushed through the flow path formed in this way. In the shown valve arrangement the valve having the next smaller flow cross-section is provided in each of the valve arrays next to the previously opened valve having the largest possible flow cross-section. In a next method step, the valve in turn having the next smaller flow cross-section is opened in each of the active valve arrays and the flow path opened in this way is flushed, etc. These steps are repeated, until all valves of the two active valve arrays shown in FIG. 3 are flushed and vented.

Figure 4:
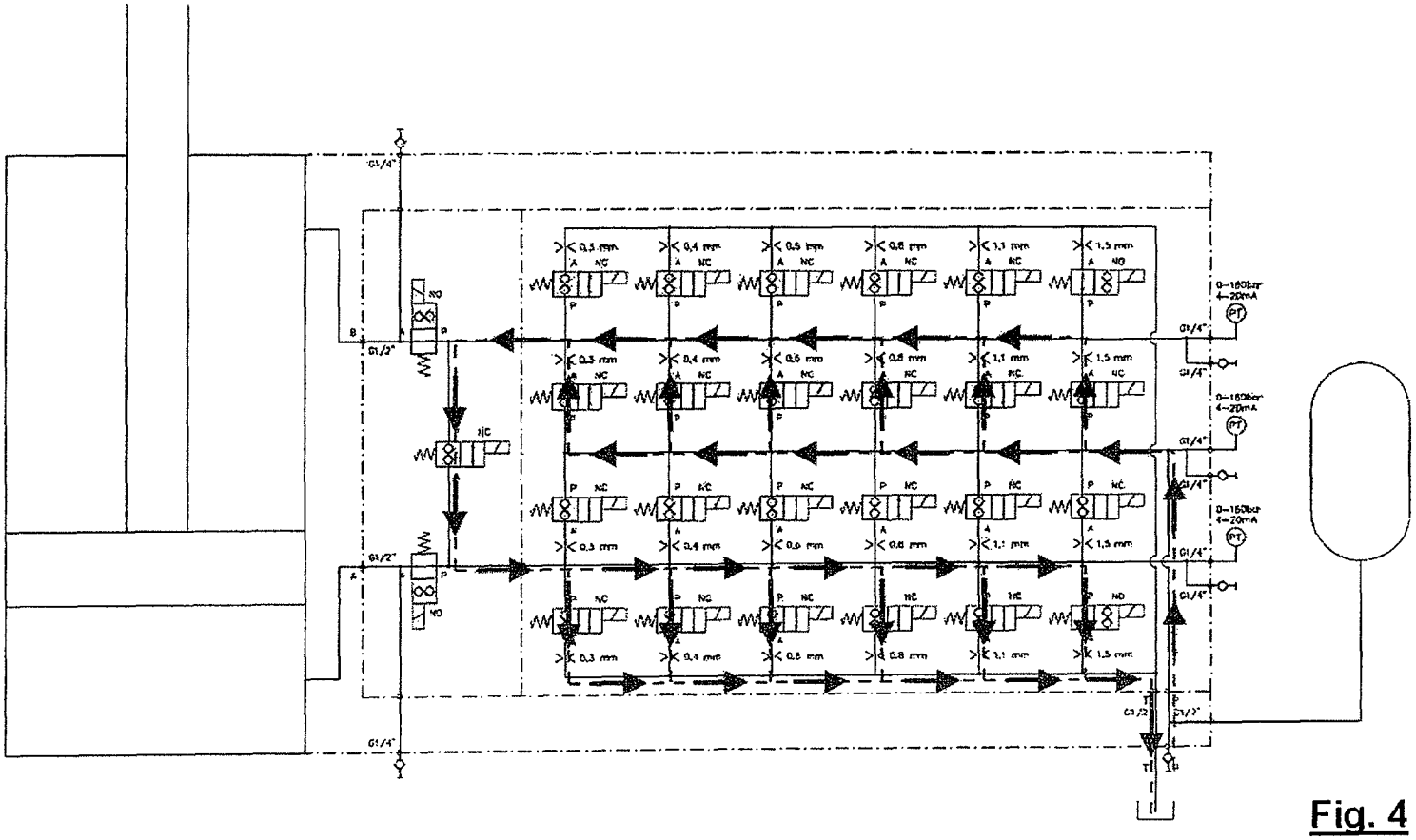
FIG. 4 shows the schematic diagram illustrated in FIG. 1 in which a flow path for venting another part of the pressure controller shown in FIG. 1 is shown with a particular switching of valves of the pressure controller.

A switching of the pressure controller 4 for venting the remaining part of the pressure controller 4 is shown in FIG. 4. Analogously to FIG. 3, first the longest flow path having the largest possible flow cross-section of the pressure controller 4 is flushed in that the pressurized working fluid is delivered by the pump 16 via the supply line 43 through the valve having the largest flow cross-section of the valve array 422 of the pressure controller portion 41 on the supply line side into the output line 413. As the output line 413 of the pressure controller portion 41 is communicated via the open overflow valve 45 with the output line 423 of the pressure controller portion 42, the working fluid is delivered into the output line 423 and further through the valve having the largest flow cross-section of the valve array 422 of the pressure controller portion 42 on the drain line side into the tank 20 and is collected there. After that, in the method shown in FIG. 4, the valve having the next smaller flow cross-section in the valve array 411 of the pressure controller portion 41 on the supply line side and the valve having the next smaller flow cross-section of the valve array 422 of the pressure controller portion 42 on the drain line side are opened. Then the working fluid is flushed through the flow path formed in this way. In the shown valve arrangement the valve having the next smaller flow cross-section is provided in each of the valve arrays next to the previously opened valve having the largest possible flow cross-section. In a next method step, the valve having the in turn next smaller flow cross-section is opened in each of the active valve arrays and the flow path opened in this way is flushed, etc. These steps are repeated, until all valves of the pressure controller 4 are flushed and vented.

Alternatively to the previously described structure of the pressure controller 4, it is not mandatory that the valves of a valve array having a decreasing flow cross-section have to be juxtaposed. It is also imaginable to provide an arbitrary arrangement of the valves in each valve array.

The invention claimed is:

1. A method of removing foreign matter from a pipeline of a digital hydraulic system, wherein the digital hydraulic system employs a pressure controller comprising a first pressure controller portion and a second pressure controller portion which are connectable to each other, wherein said first pressure controller portion has a first valve array, connected between a supply line and a first output line, and wherein in the first valve array there are a plurality of individually switchable valves that have respective different flow cross-sections, the plurality of individually switchable valves including one of said valves which is largest and which plurality of individually switchable valves are connected in parallel;

wherein said first pressure controller portion has a second valve array, connected between a drain line and the first output line and wherein in the second valve array there are a plurality of individually switchable valves that have respective different flow cross-sections, the plurality of individually switchable valves including one of said valves which is largest and which second valve array plurality of individually switchable valves are connected in parallel;

and wherein said second pressure controller portion has a first valve array, connected between the supply line and a second output line and wherein in the second pressure controller portion first valve array there are a plurality of individually switchable valves that have respective different flow cross-sections, the plurality of individually switchable valves including one of said valves which is largest and which plurality of individually switchable valves are connected in parallel;

wherein said second pressure controller portion has a second valve array, connected between the drain line and the second output line and wherein in the second pressure controller portion second valve array there are a plurality of individually switchable valves that have respective different flow cross-sections, the plurality of individually switchable valves including one of said valves which is largest and which plurality of individually switchable valves are connected in parallel;

wherein the method comprises the steps of:

connecting the first pressure controller portion to the second pressure controller portion by connecting the first output line to the second output line;

opening the valve having the largest flow cross-section in the first valve array of the first pressure controller portion;

opening the valve having the largest flow cross-section of the second valve array of the second pressure controller portion so forming an opened flow path from the supply line through the first and second output lines to the drain line; and flushing the opened flow path through the pressure controllers with a pressurized working fluid, while all other valves are closed.

2. The method of claim 1, wherein the method further comprises the steps of:

opening a valve having a next smaller flow cross-section of the first valve array of the first pressure controller portion which connects to the supply line;

opening a valve having a next smaller flow cross-section of the second valve array of the second pressure controller portion which connects to the drain line to form an opened flow path from the supply line through the first and second output lines to the drain line; and flushing the further opened flow path through the pressure controllers with the working fluid, while all other valves are closed.

3. The method of claim 2, wherein the steps of claim 2 are repeated until all valves of the first valve array of the first pressure controller portion and all valves of the second valve array of the second pressure controller portion are flushed.

4. The method of claim 3, wherein the method further comprises the steps of:

opening the valve having the largest flow cross-section of the first valve array of the second pressure controller portion;

opening the valve having the largest flow cross-section of the second valve array of the first pressure controller portion; and flushing the opened flow path through the pressure controllers with the working fluid, while all other valves are closed.

5. The method of claim 4, wherein the method further comprises the steps of:

opening a valve having a next smaller flow cross-section of the first valve array of the second pressure controller portion which connects to the supply line;

opening a valve having a next smaller flow cross-section of the second valve array of the first pressure controller portion which connects to the drain line to form an open flow path from the supply line through the first and second output lines to the drain line; and flushing the opened flow path through the pressure controllers with the working fluid, while all other valves are closed.

6. The method of claim 5, wherein the steps of claim 5 are repeated until all the valves of the first valve array of the second pressure controller portion and all the valves of the second valve array of the first pressure controller portion are flushed.

7. The method of claim 1 wherein the first and second pressure controller portions and their respective first and second valve arrays have each in their plurality of individually switchable valves flow cross-sections which are stepwise different from each other.

8. The method of claim 1 wherein the working fluid is stored in a pressure reservoir before the working fluid is used for flushing.

9. The method of claim 1 wherein the working fluid is pressurized by a pump.

10. The method of claim 1 wherein the method comprises, after the step of flushing, the further step of collecting the working fluid in a tank for storing non-pressurized working fluid.

11. A method of removing foreign matter from a pipeline of a digital hydraulic system, comprising:

connecting a first output line to a second output line;

opening one valve in a first array of valves having a progression of sizes, wherein said valve has a flow cross-section which is largest with respect to the each of the valves in the array, wherein the valves of the array are connected between a supply line and the first output line;

opening one valve in a second array of valves wherein said valve has a flow cross-section which is largest with respect to the each of the valves in the second array, wherein the valves of the second array are connected between the second output line and a drain line to form an open path;

flushing the open flow path with a working fluid while all other valves are closed;

repeating the forgoing three steps with a valve in the first array and a valve in the second array having a next smaller flow cross-section to form the open path, until all valves in the first and second valve arrays have been flushed; and opening one valve in a third array of valves wherein said valve has a flow cross-section which is largest with respect to the each of the valves in the third array, wherein the valves of the third array are connected between the drain line and the first output line;

opening one valve in a fourth array of valves wherein said valve has a flow cross-section which is largest with respect to each of the valves in the fourth array, wherein the valves of the fourth array are connected between the second output line and the supply line to form an open path;

flushing the open flow path of the fourth array with the working fluid, while all other valves are closed; and repeating the forgoing three steps with a valve in the third array and a valve in the fourth array having a next smaller flow cross-section to form the respective open path, until all valves in the third and fourth valve arrays have been flushed.

12. A method of removing foreign matter from a pipeline of a digital hydraulic system, comprising:

connecting a first output line to a second output line;

opening one valve in a first array of valves wherein said valve has a flow cross-section which is largest with respect to the each of the valves in the array, wherein the valves of the array are connected between a supply line and the first output line;

opening one valve in a second array of valves wherein said valve has a flow cross-section which is largest with respect to each of the valves in the second array, wherein the valves of the second array are connected between the second output line and a drain line to form an open flow path;

flushing the open flow path with the working fluid, while all other valves not part of the open flow path are closed; and opening one valve in a third array of valves wherein said valve has a flow cross-section which is largest with respect to each of the valves in the third array, whereby the valves of the third array are connected between the drain line and the first output line;

opening one valve in a fourth array of valves wherein said valve has a flow cross-section which is largest with respect to each of the valves in the fourth array, wherein the valves of the fourth array are connected between the second output line and the supply line to form an open path; and flushing the open flow path of the fourth array with the working fluid, while all other valves are closed.

13. The method of claim 12 further comprising repeating the second, third and fourth steps of claim 12 with a valve in the first array and a valve in the second array having a next smaller flow cross-section to form the open path, until all valves in the first and second valve arrays have been flushed.

14. The method of claim 13 further comprising repeating the fifth, sixth and seventh steps of claim 12 with a valve in the third array and a valve in the fourth array having a next smaller flow cross-section to form the open path, until all valves in the third and fourth valve arrays have been flushed.

* * * * *